US008542168B2

(12) United States Patent
Mori et al.

(10) Patent No.: US 8,542,168 B2
(45) Date of Patent: Sep. 24, 2013

(54) DISPLAY DEVICE

(75) Inventors: Ikuko Mori, Chiba (JP); Kikuo Ono, Mobara (JP)

(73) Assignees: Hitachi Displays, Ltd., Chiba (JP); Panasonic Liquid Crystal Display Co., Ltd., Hyogo-Ken (JP)

( * ) Notice: Subject to any disclaimer, the term of this patent is extended or adjusted under 35 U.S.C. 154(b) by 1533 days.

(21) Appl. No.: 11/857,474

(22) Filed: Sep. 19, 2007

(65) Prior Publication Data

US 2008/0068299 A1 Mar. 20, 2008

(30) Foreign Application Priority Data

Sep. 19, 2006 (JP) ..... 2006-252133

(51) Int. Cl.
*G09G 3/36* (2006.01)

(52) U.S. Cl.
USPC ..... 345/87; 345/55; 345/204

(58) Field of Classification Search
USPC ..... 345/55, 87, 204
See application file for complete search history.

(56) References Cited

U.S. PATENT DOCUMENTS

| | | | | |
|---|---|---|---|---|
| 4,651,148 | A | 3/1987 | Takeda et al. | |
| 6,323,880 | B1 * | 11/2001 | Yamada | 345/690 |
| 6,989,812 | B2 | 1/2006 | Arimoto et al. | |
| 7,280,103 | B2 | 10/2007 | Taoka et al. | |
| 7,446,760 | B2 | 11/2008 | Takada et al. | |
| 2003/0006948 | A1 * | 1/2003 | Son et al. | 345/87 |
| 2003/0122765 | A1 * | 7/2003 | Yoon | 345/94 |
| 2004/0155847 | A1 * | 8/2004 | Taoka et al. | 345/87 |
| 2004/0183792 | A1 * | 9/2004 | Takada et al. | 345/204 |
| 2005/0041047 | A1 * | 2/2005 | Miyata et al. | 345/690 |
| 2007/0097057 | A1 * | 5/2007 | Shin | 345/98 |
| 2007/0146394 | A1 * | 6/2007 | Ahn | 345/690 |

FOREIGN PATENT DOCUMENTS

| | | |
|---|---|---|
| JP | 08-248385 | 9/1996 |
| JP | 2002-328654 | 11/2002 |
| JP | 2003-280599 | 10/2003 |
| JP | 2004-240317 | 8/2004 |
| JP | 2004-279741 | 10/2004 |
| JP | 2005-006275 | 1/2005 |

* cited by examiner

*Primary Examiner* — Sumati Lefkowitz
*Assistant Examiner* — Jose Soto Lopez
(74) *Attorney, Agent, or Firm* — Antonelli, Terry, Stout & Kraus, LLP.

(57) ABSTRACT

The present invention provides a display method realizing reduction in a moving picture blurring by forming one frame by two fields of different luminance, in which increase in an unapplied voltage due to shortening of data voltage write time is suppressed. A gate voltage is applied in a light field for a period of time which is twice as long as scan line selection time, thereby decreasing an unapplied voltage. On the other hand, a gate voltage is applied normally in a dark field for the scan line selection time, so that the case where the unapplied voltage increases is eliminated. As a result, an image with high reproducibility can be obtained.

16 Claims, 6 Drawing Sheets

DISPLAY DEVICE

CLAIM OF PRIORITY

The present application claims priority from Japanese Application JP 2006-252133 filed on Sep. 19, 2006, the content of which is hereby incorporated by reference into this application.

BACKGROUND OF THE INVENTION (1) Field of the Invention

The present invention relates to a hold-response-type display device such as a liquid crystal display device or an organic EL display and, more particularly, to a display device suitable for a large screen and display of a moving picture.

(2) Description of the Related Art

In a liquid crystal display device, a number of pixels are formed in a matrix and are surrounded by data signal lines extending in the vertical direction and arranged in the lateral direction and scan lines extending in the lateral direction and arranged in the vertical direction. When a scan line is selected by a scan driver, image data of one line is written at once to pixels on the selected scan line by a data driver. As the size of the screen of a liquid crystal display for TV is increasing, the number of scan lines is also increasing. On the other hand, the period of one frame is unchanged. Therefore, when the screen becomes larger, the time of writing image data to pixels is short, and a phenomenon occurs such that reproduction of an image is insufficient.

As a countermeasure against insufficient time to write data to pixels, there is means for compensating the insufficient write time by pre-writing data to a scan line immediately preceding the scan line to be selected. The technique is disclosed in, for example, Japanese Patent Application Laid-Open Publication No. H8-248385.

A liquid crystal display device and an organic EL display device have another problem such that the picture quality of a moving picture is not sufficiently high due to the following phenomenon.

From the viewpoint of display of moving pictures, the display devices are largely divided into an impulse-response-type display and a hold-response-type display. The impulse-response-type display is of a type in which luminance response decreases immediately after a scan like the light emission characteristic of a cathode ray tube. The hold-response display is of a type in which luminance based on display data is held to the next scan like a liquid crystal display.

Although the hold-response-type display can display a flicker-free still picture having excellent quality, in the case of displaying a moving picture, there is a problem of low picture quality. A so-called moving picture blurring that the surrounding of a moving object in a moving picture is blurred occurs. The moving picture blurring occurs due to a so-called afterimage. When the user moves his/her visual line along a moving object, the user interpolates display images before and after the display image whose luminance is held. Therefore, even if the response of the display is increased, the moving picture blurring is not completely prevented. To solve the problem, a method of updating a display image at a shorter frequency and a method of cancelling an afterimage by insertion of a black screen so that the display becomes like an impulse-response-type display are effective.

On the other hand, a representative display requested to display a moving picture is a television receiver set. The frequency of the television receiver set is a standardized signal such as 60 Hz in an NTSC signal and 50 Hz in a PAL signal. In the case where the frame frequency of a display image generated on the basis of the frequency is set to 60 Hz or 50 Hz, due to low frequency, the moving picture blurring occurs.

To reduce the moving picture blurring, as a technique of updating an image in cycles shorter than the above, there is a method of increasing the scan frequency and generating display data of an interpolation frame on the basis of display data between frames, thereby increasing the image updating speed. Japanese Patent Application Laid-Open Publication No. 2005-6275 discloses the technique. The technique of inserting a black frame (black image) includes a technique of inserting black display data between display data (hereinbelow, simply called black display data insertion method) and a technique of repeating turn-on and turn-off of a backlight (hereinbelow, simply called blink backlight method). For example, the technique is disclosed in Japanese Patent Application Laid-Open Publication No. 2003-280599.

When an attempt is made to shorten the write time and to reduce the moving picture blurring by applying the above-mentioned techniques, a new problem occurs. For example, the problem of the countermeasure against the moving picture blurring is as follows.

In the interpolation frame generating method, display data which is not originally present is formed. Accordingly, in an attempt to generate more accurate data, the circuit scale enlarges. On the other hand, when the circuit scale is suppressed, an interpolation error occurs.

In the method of inserting the black frame, in principle, no interpolation error occurs. Also from the viewpoint of the circuit scale, the method is more advantageous than the interpolation frame generating method. However, in both of the black display data insertion method and the blink backlight method, luminance at all of levels of gray decreases only by the amount of black frames.

As a method obtained by improving the method of inserting black frames, there is a method of inserting black data while suppressing decrease in luminance by forming one frame by two fields. In the improved method, specifically, two field memories are prepared. By writing image data of two fields to a liquid crystal display at a frequency twice as high as that of an input signal, one frame is formed by the two fields. FIG. 2 shows the relation between the tone and luminance in the two fields.

In FIG. 2, 256 gray scales are displayed. The first field undertakes the luminance when the gray scale is 171 or less. When the gray scale is 171 or less, an output from the second field may be zero. That is, when the gray scale is 171 or less, black data can be inserted without accompanying decrease in luminance. When the gray scale exceeds 171, for example, when the gray scale shown in FIG. 2 is 200, image data is output also from the second field. However, the luminance is lower than that of the first field, so that moving picture blurring can be lessened.

However, in the method, one frame is formed by two fields. Consequently, the time of writing image data to pixels is the half of the time of a normal driving method, so that increase in the unapplied voltage due to decrease in the data write time becomes a big issue. When the technique of Japanese Patent Application Laid-Open Publication No. H8-248385 is applied to the method of forming one frame by two fields of different luminance, a problem occurs such that the unapplied voltage rather increases in some cases.

SUMMARY OF THE INVENTION

To prevent a moving picture blurring, one frame is formed by two fields of a light field and a dark field. As a countermeasure against decrease in write time of data to pixels, pre-writing is started at the time of a scan just before a scan line to be selected. Since there is a case that a side effect of the pre-writing occurs in the dark field, the pre-writing is performed in the light field, and the pre-writing is not performed in the dark field.

Concrete Examples will be Described Below.

(1) The present invention provides a display device including a number of pixels formed in a matrix and surrounded by a plurality of data signal lines extended in a vertical direction and arranged in a lateral direction and a plurality of scan lines extended in the lateral direction and arranged in the vertical direction, a scan line being selected by application of a gate voltage to the scan line, and a pixel voltage being supplied to pixels from a data signal line, wherein data of a field of relatively high luminance and a field of relatively low luminance is generated from input image data of one frame, at the time of generating an image of the field of relatively high luminance, a scan line connected to the pixel is selected twice in a row in one field and, at the time of generating an image of the field of relatively low luminance, the scan line connected to the pixel is selected once in one field.

(2) The display device of (1) may be a hold-response-type display device that holds display of tone for a predetermined period.

(3) The display device of (1) may be a liquid crystal display device.

(4) The display device of (1) may be an organic EL display device.

(5) The present invention also provides a display device including a number of pixels formed in a matrix and surrounded by a plurality of data signal lines extended in a vertical direction and arranged in a lateral direction and a plurality of scan lines extended in the lateral direction and arranged in the vertical direction, a scan line being selected by application of a gate voltage to the scan line, and a pixel voltage being supplied to pixels from a data signal line, wherein data of a field of relatively high luminance and a field of relatively low luminance is generated from input image data of one frame, at the time of generating an image of the field of relatively high luminance, two kinds of image voltages are successively supplied from the data signal line to the pixels in one field, and at the time of generating an image of the field of relatively low luminance, one kind of image voltage is supplied from the data signal line to the pixels in one field.

(6) The display device of (5) may be a hold-response-type display device that holds display of tone for a predetermined period.

(7) The display device of (5) may be a liquid crystal display device.

(8) The display device of (5) may be an organic EL display device.

(9) The present invention also provides a display device including a number of pixels formed in a matrix and surrounded by a plurality of data signal lines extended in a vertical direction and arranged in a lateral direction and a plurality of scan lines extended in the lateral direction and arranged in the vertical direction, a scan line being selected by application of a gate voltage to the scan line, and a pixel voltage being supplied to pixels from a data signal line, wherein data of three fields is generated from input image data of one frame, the three fields being a field of relatively high luminance, a field of intermediate luminance, and a field of relatively low luminance, at the time of generating an image of the field of relatively high luminance, a scan line connected to the pixel is selected twice in a row in one field, and at the time of generating an image of the field of relatively low luminance, the scan line connected to the pixel is selected once in one field.

(10) In the display device of (9), when the field of intermediate luminance follows the field of relatively high luminance, the scan line connected to the pixels is selected once in one field.

(11) In the display device of (9), when the field of intermediate luminance follows the field of relatively low luminance, a scan line connected to the pixels is selected twice in a row in one field.

(12) The present invention provides a display device including a number of pixels formed in a matrix and surrounded by a plurality of data signal lines extended in a vertical direction and arranged in a lateral direction and a plurality of scan lines extended in the lateral direction and arranged in the vertical direction, a scan line being selected by application of a gate voltage to the scan line, and a pixel voltage being supplied to pixels from a data signal line, wherein data of three fields is generated from input image data of one frame, the three fields being a field of relatively high luminance, a field of intermediate luminance, and a field of relatively low luminance, at the time of generating an image of the field of relatively high luminance, two kinds of image voltages are supplied successively from a data signal line to pixels in one field, and at the time of generating an image of the field of relatively low luminance, one kind of image voltage is supplied from a data signal line to the pixels in one field.

(13) In the display device of (12), when the field of intermediate luminance follows the field of relatively high luminance, two kinds of image voltages are supplied successively from a data signal line to the pixels in one field.

(14) In the display device of (12), when the field of intermediate luminance follows the field of relatively low luminance, two kinds of image voltages are supplied successively from a data signal line to the pixels in one field.

(15) The present invention also provides a display device including a number of pixels formed in a matrix and surrounded by a plurality of data signal lines extended in a vertical direction and arranged in a lateral direction and a plurality of scan lines extended in the lateral direction and arranged in the vertical direction, a scan line being selected by application of a gate voltage to the scan line, and a pixel voltage being supplied to pixels from a data signal line, wherein in the case where data of four or more fields of different luminance including a field of maximum luminance and a field of minimum luminance is generated from input image data of one frame and an image is formed by the fields, in a method of driving a specific field, when two frames are successively selected, if a field of luminance lower than that of the specific field is set before the specific field, a scan line connected to pixels is selected twice in a row in one field in the specific field, and when a field having luminance higher than that of the specific field is set before the specific field, a scan line connected to pixels in the specific field is selected once in one field.

In (1) to (8), in the drive method realizing reduction in a moving picture blurring by making one frame of a light field and a dark field, the voltage which is not applied due to shortening of the time of writing the data voltage to pixels is reduced, so that an image with high reproducibility can be obtained.

In (9) to (14), in the drive method realizing reduction in a moving picture blurring by making one frame of three fields of different luminance, the voltage which is not applied due to shortening of the time of writing the data voltage to pixels is reduced, so that an image with high reproducibility can be obtained.

In (15), in the drive method realizing reduction in a moving picture blurring by making one frame of four or more fields of different luminance, the voltage which is not applied due to further shortening of the time of writing the data voltage to pixels is reduced, so that an image with high reproducibility can be obtained.

BRIEF DESCRIPTION OF THE DRAWINGS

These and other features, objects and advantages of the present invention will become more apparent from the following description when taken in conjunction with the accompanying drawings wherein.

DETAILED DESCRIPTION OF THE PREFERRED EMBODIMENTS

The details of the present invention will be disclosed by embodiments.

First Embodiment

Figure 1:
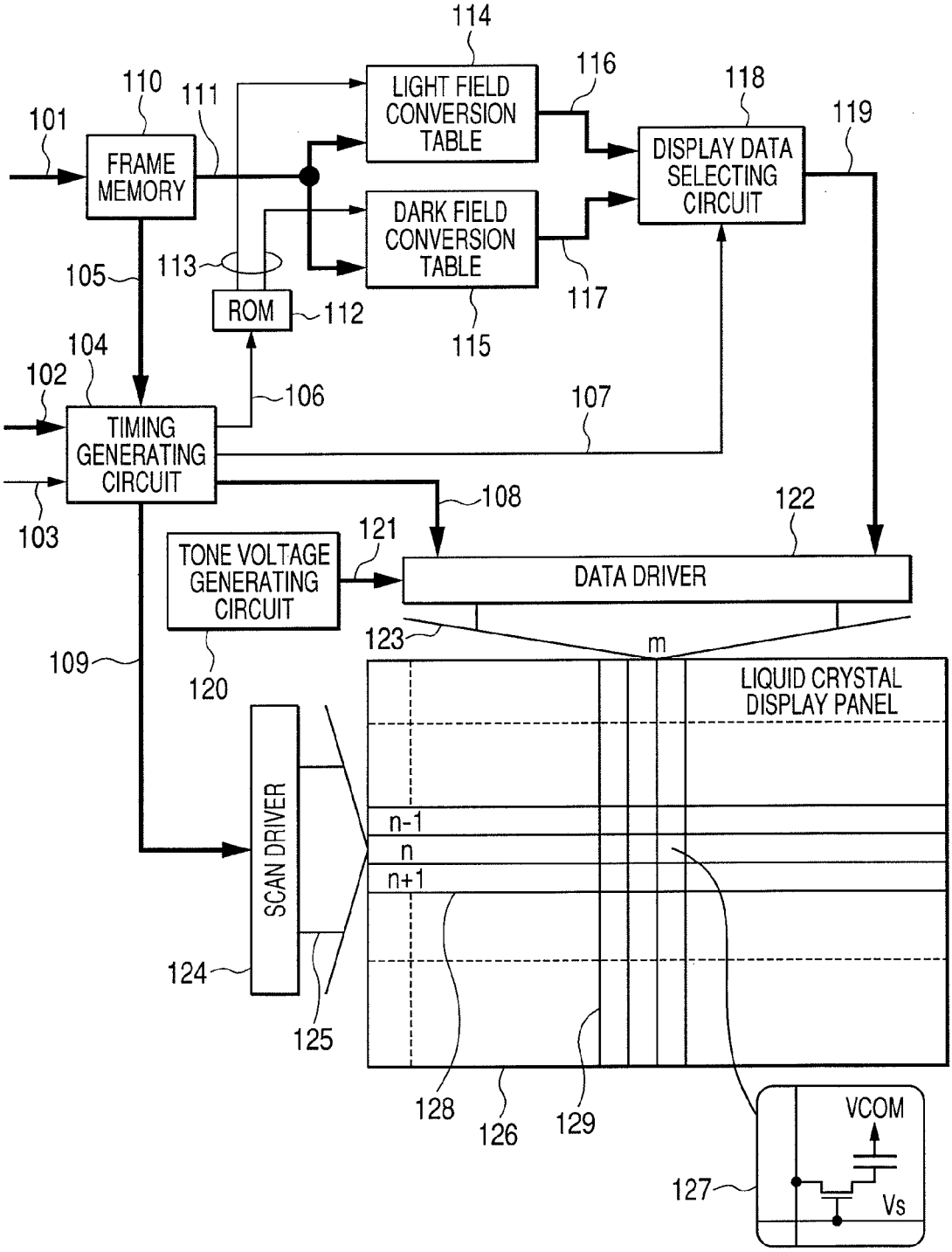
FIG. 1 shows the configuration of a liquid crystal display device.

FIG. 1 is a diagram showing the configuration of a liquid crystal display device. The device supports 256 levels of gray in each of R, G, and B colors and displays total 16,770,000 colors. 101 denotes input display data of total 24 bits; eight bits of R, eight bits of G, and eight bits of B. 102 denotes an input signal group. The input signal group 102 is constructed by a vertical sync signal Vsync specifying one frame period (a period of displaying one screen), a horizontal sync signal Hsync specifying one horizontal period (a period of displaying one line), a display timing signal DISP specifying a display data valid period, and a reference clock signal DCLK synchronized with display data.

103 denotes a drive selection signal. Based on the drive selection signal 103, either an existing driving method or an improved driving method with reduced moving picture blurring is selected. The input display data 101, the input signal group 102, and the drive selection signal 103 are transferred from an external system (such as a TV body, a PV body, or a cellular phone body).

104 denotes a timing signal generation circuit, 105 denotes a memory control signal group, 106 denotes a table initialize signal, 107 indicates a data selection signal, 108 indicates a data driver control signal group, and 109 expresses a scan driver control signal group. The data driver control signal group 108 is made of an output signal CL1 specifying an output timing of a tone voltage on the basis of display data, an AC signal M determining the polarity of a source voltage, and a clock signal PCLK synchronized with display data. The scan driver control signal group 109 is made of a shift signal CL3 specifying the scan period of one line, and a vertical start signal FLM specifying the scan start of the head line.

110 denotes a frame memory having a capacity of at least one frame of display data. A display data reading/writing process is performed on the basis of the memory control signal group 105. 111 denotes memory read data that is read from the frame memory 110 on the basis of the memory control signal group 105. 112 denotes a ROM (Read Only Memory) for outputting internally stored data on the basis of a table initialize signal. 113 denotes table data output from the ROM, 114 denotes a light field conversion table, 115 denotes a dark field conversion table.

The values in the tables are set on the basis of the table data 113 at power-on, and the memory read data 111 which is read is converted on the basis of the values set in the tables. The light field conversion table 114 has the function of the data conversion circuit for light fields, and the dark field conversion table 115 has the function of the data conversion circuit for dark fields.

116 denotes light field display data converted with the light field conversion table 114. 117 denotes dark field display data converted with the dark field conversion table 115. 118 denotes a display data selection circuit which selectively outputs the light field display data 116 or the dark field display data 117 on the basis of the data selection signal 107. 119 denotes the selected field display data.

120 denotes a tone voltage generating circuit, and 121 denotes a tone voltage. 122 indicates a data driver. The data driver 122 generates potentials of total 512 levels; 256 levels ($=2^8$ (the eighth power of 2)) of the positive polarity, and 256 levels of the negative polarity from the tone voltage 121, selects the potential of one level corresponding to the field display data 119 of eight bits per color and the polarity signal M, and applies it as data voltage to a liquid crystal display panel 126.

123 denotes a data voltage generated by the data driver 122. 124 denotes a scan driver, and 125 denotes a scan line selection signal. The scan driver 124 generates the scan line selection signal 125 on the basis of the scan driver control signal group 109 and outputs it to the scan line of the liquid crystal display panel.

126 denotes a liquid crystal display panel, and 127 is a schematic diagram of one pixel in the liquid crystal display panel 126. The pixel 127 is formed in an area surrounded by two scan lines 128 and two data signal lines 129. One pixel in the liquid crystal panel 126 is constructed by a TFT (Thin Film Transistor) made by a source electrode, a gate electrode, and a drain electrode, a liquid crystal layer, and opposed electrodes. By applying a scan signal to the gate electrode, the switching operation of the TFT is performed. In an open state of the TFT, the data voltage is written in the source electrode connected to one of the liquid crystal layers via the drain electrode. In a closed state, the voltage written in the source electrode is held. The voltage of the source electrode is the same as the voltage of a transparent electrode ITO as a pixel electrode for driving the actual liquid crystal layer. The voltage of the pixel electrode is set as Vp, and the voltage of the opposed electrode is set as Vcom. The polarization direction of the liquid crystal layer changes on the basis of the potential difference between the pixel electrode voltage Vp and the opposed electrode voltage Vcom, and the amount of light transmission from a back light disposed on the back side is changed via polarizing plates disposed above and below the liquid crystal layer, thereby performing tone display.

Figure 2:
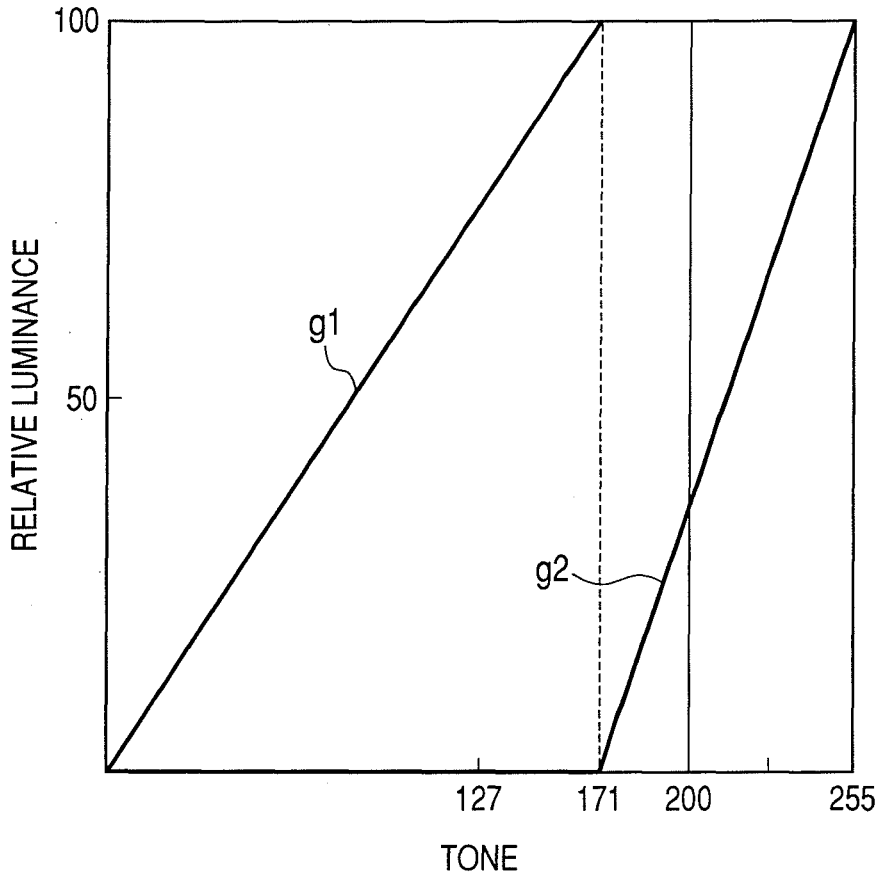
FIG. 2 shows a tone-luminance characteristic in each field of a first embodiment.

FIG. 2 shows the relation between the tone and luminance of two fields. In FIG. 2, 256 gray scales are displayed. The first field undertakes the luminance when the gray scale is 171 or less. When the gray scale is 171 or less, an output from the second field may be zero. That is, when the gray scale is 171 or less, black data can be inserted without accompanying decrease in luminance. When the gray scale exceeds 171, for example, when the gray scale shown in FIG. 2 is 200, image data is output also from the second field. However, the luminance is lower than that of the first field, so that moving picture blurring can be lessened.

As described above, the method of forming one frame by a light field and a dark field is excellent from the viewpoint that an effect similar to that of insertion of black data can be obtained without accompanying decrease in luminance. However, a problem arises such that field display data has to be written to the liquid crystal display panel at a speed twice as fast as that of input display data from the system.

Specifically, image data is not sufficiently written since time in which the scan line 128 is selected is short, and a phenomenon occurs such that an image cannot be completely reproduced. In the method of forming one frame by a light field and a dark field, the circumstances in which the phenomenon that image data cannot be sufficiently written occurs vary between the case of the light field and the case of the dark field.

In an actual operation, the light field and the dark field are displayed alternately. In the case of writing the data voltage Vd in the light field, the voltage Vp of the pixel electrode before the writing is lower than the data voltage Vd to be written for the reason that the pixel voltage Vp in the dark field is always lower than that in the light field. On the other hand, the pixel voltage Vp before writing is higher than the data voltage Vd to be written. Therefore, in the following, the case of the light field and the case of the dark field will be described separately.

Figure 3:
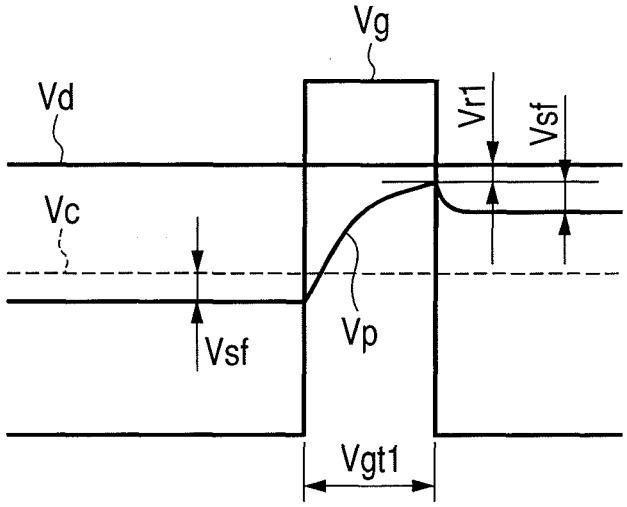
FIG. 3 shows an example of single-pulse writing in a light field.

FIG. 3 shows a signal voltage write state in the normal driving method in the case of the light field. In the normal writing method, when a specific gate line is selected, the gate signal Vg is applied and the data voltage Vd is written in the pixel electrode only in the period of the selection. Hereinafter, the writing method will be called single-pulse writing.

FIG. 3 shows how the potential of the pixel 127 changes when a specific scan line, for example, "n" in FIG. 1 is selected. The n-th scan line is selected and the gate voltage Vg is applied to the TFT. The TFT is turned on, and the data voltage Vd is written. In FIG. 3, it is assumed that the data voltage Vd is the same as the signal voltage of the immediately preceding scan line n−1. When TFT is turned on, the data voltage Vd is written to the pixel electrode. However, the potential Vp of the pixel electrode does not immediately become the signal voltage Vd due to circuit resistance, capacitance, and the like but becomes close to the signal voltage Vd while drawing a curve like charging of a capacitor. The gate voltage application time in this case is Vgt1. However, the time is not sufficient for writing of the data voltage Vd. Consequently, the pixel electrode potential Vp does not increase to the data voltage Vd but below the data voltage by an unapplied voltage Vr1, and the TFT is turned off. That is, an image which is in accurate only by the voltage Vrt is displayed. Vsf in FIG. 3 is a so-called V shift at which the pixel voltage changes due to the gate voltage. Vc denotes a midpoint potential. In short, in the liquid crystal display device, to prevent degradation of the liquid crystal, so-called AC driving of changing the polarity of the data voltage Vd every predetermined time is performed. Vc denotes the midpoint potential of the data voltage Vd used for the AC driving.

Figure 4:
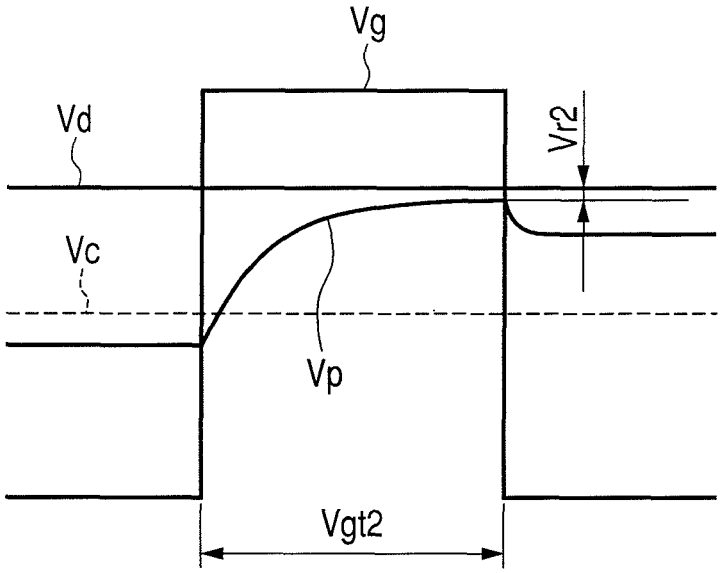
FIG. 4 shows an example of double-pulse writing in a light field.

FIG. 4 shows a countermeasure against insufficient rise in the source electrode potential in the light field. The point of FIG. 4 largely different from FIG. 3 is that the time Vgt2 of application of the gate voltage Vg is twice as long as the time Vgt1 of application of the gate voltage Vg in FIG. 3. In FIG. 4, it is also assumed that the data voltage Vd in the case of the scan line n−1 and the data voltage Vd in the scan line "n" are the same. In FIG. 4, when a scan line immediately before selection of "n" in FIG. 1, that is, n−1 in FIG. 1 is selected, the gate voltage Vg is also applied simultaneously to the scan line "n". Consequently, the signal voltage Vd can be written to the pixels corresponding to the scan line "n" for the time Vgt2 which is twice as long as the normal gate voltage application time Vgt1. Hereinafter, the method will be called double-pulse writing. In the double-pulse writing, the write time of the signal voltage Vd is long, so that the pixel electrode potential Vp can be set to almost the same level as the signal voltage Vd. In other words, unapplied voltage Vr2 in FIG. 4 is largely lower than unapplied voltage Vr1 in FIG. 3. Therefore, an image more accurate than that in the case of FIG. 3 can be reproduced.

Figure 5:
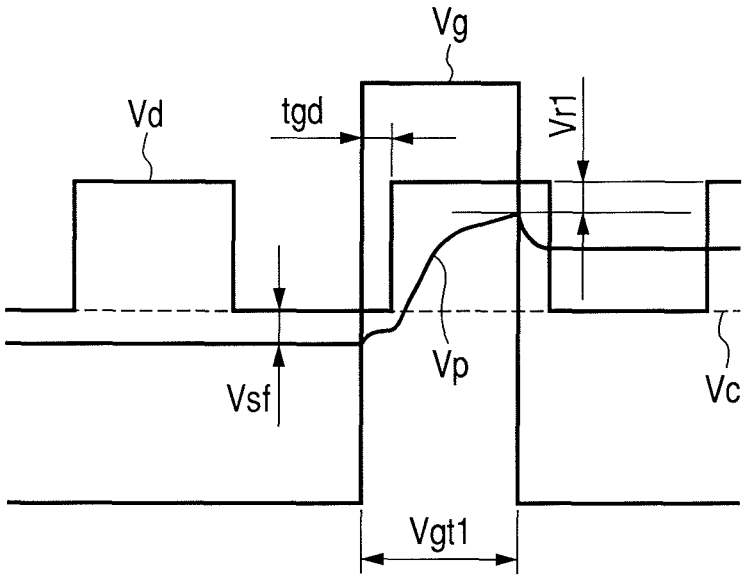
FIG. 5 shows another example of single-pulse writing in a light field.
Figure 6:
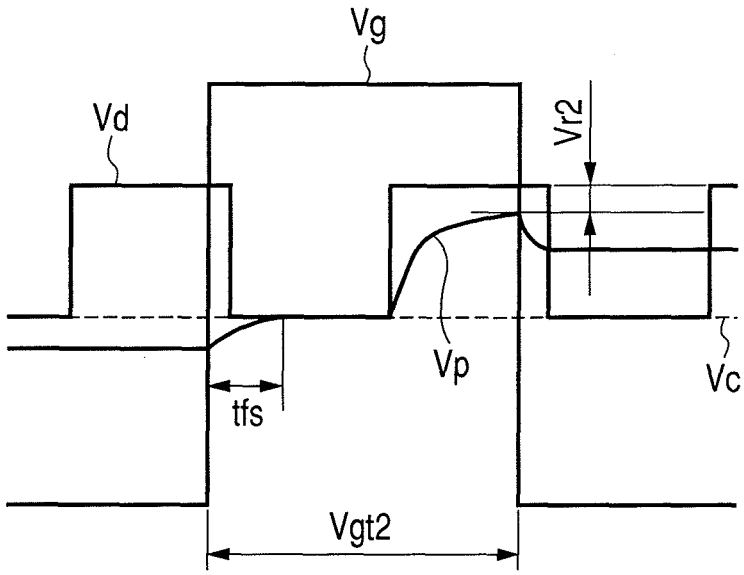
FIG. 6 shows another example of double-pulse writing in a light field.

FIGS. 3 and 4 have been described on assumption that the data voltage Vd of the scan line n−1 and the data voltage Vd of the scan line "n" are the same. FIGS. 3 and 4 show the case where the double-pulse writing is the most effective. FIGS. 5 and 6 shows comparison between the double-pulse writing and single-pulse writing in the case opposite to the FIGS. 3 and 4 and where the data voltage Vd of the scan line n−1 is zero, and the data voltage Vd of the scan line "n" is specific voltage.

FIG. 5 shows the case where the data voltage Vd of the scan line n−1 is zero and the data voltage Vd of the scan line "n" is specific voltage in the single pulse writing. In FIG. 5, when the gate voltage Vg is applied, a V shift Vsf occurs, and the voltage of the pixel electrode is increased to a middle point Vc of the data voltage. The V shift requires predetermined time tfs. tfs is defined in FIG. 6. On the other hand, as shown in FIG. 5, the pulse of the gate voltage Vg is applied before the pulse of the data voltage Vd only by tgd. Generally, tfs is longer than tgd, so that writing of the data voltage starts before the pixel voltage Vp reaches the middle point Vc of the data voltage. That is, when the pixel voltage Vp does not reach the middle point Vc of the data voltage, the unapplied voltage Vr1 increases.

FIG. 6 shows the case where the data voltage Vd of the scan line n−1 is zero and the data voltage Vd of the scan line "n" is specific voltage in the double pulse writing. In this case, since the data voltage Vd of the scan line n−1 is zero, there is no effect produced by preliminarily increasing the data voltage of the scan line "n" by the data voltage Vd of the scan line n−1. However, when the scan line n−1 is selected, the gate voltage Vd is already applied also to the scan line "n". Consequently, when the data voltage Vd corresponding to the scan line "n" is actually applied, the V shift Vsf is completely finished, and the data voltage Vd corresponding to the scan line "n" is applied from the middle potential Vc. Therefore, the unapplied voltage does not increase by the amount the pixel voltage Vp does not reach the middle point Vc of the data voltage.

By the amount, the unapplied voltage Vr2 in the double-pulse writing can be made smaller than that in the single-pulse writing.

In the case of FIG. 6, although the effect of the double-pulse writing in the light field is suppressed most, a predetermined effect can be produced as described above. Therefore, in the light fields, in all of the cases, the unapplied voltage can be reduced by using the double pulse writing.

The data voltage Vd(n−1) in the case where the scan line n−1 is selected and the data voltage Vd(n) in the case where the scan line "n" is selected are generally different from each other. Therefore, the influence of this in the double pulse writing has to be evaluated as follows. The pixel electrode voltage Vp written by the voltage Vd(n−1) to the scan line "n" upon writing of the scan line n−1 is held only for the gate voltage application time Vgt1 for the reason that the pixel electrode voltage Vp is overwritten with the original voltage Vd(n). There is consequently hardly any influence on the image Vd(n−1). For example, the number of scan lines in a WXGA screen is 768. In this case, the application time of Vd(n−1) is one scan period, and the voltage Vd(n) is applied for the time in which 767 scan lines are scanned. Therefore, the influence on an image of Vd(n−1) is 1/767 of the influence of Vd(n) and is ignorable. Thus, even if the double-pulse writing is used, degradation in the picture quality can be ignored.

The case of the dark field will now be described. Since the dark field follows the light field, the pixel voltage Vp before the data voltage Vd is applied is always higher than the data voltage Vd to be applied.

Figure 7:
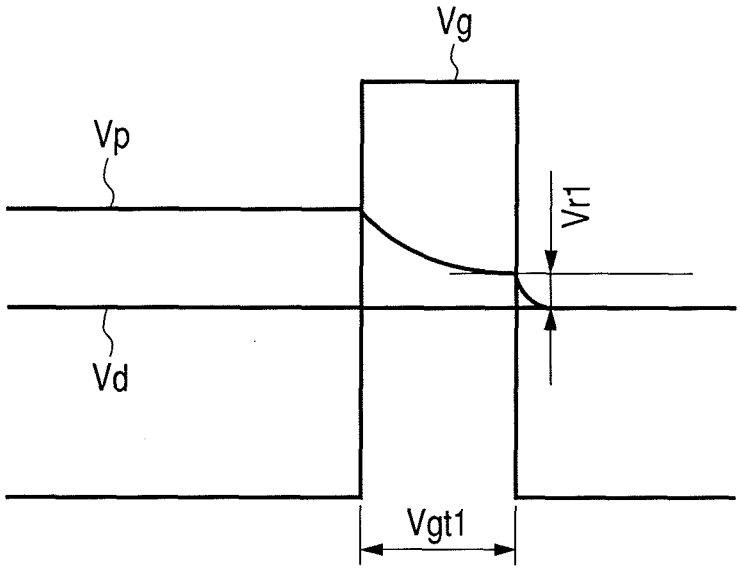
FIG. 7 shows an example of single-pulse writing in a dark field.

FIG. 7 shows the relation between the data voltage Vd and the pixel voltage Vp in the single-pulse writing. In this case, the pixel voltage Vp before writing is a predetermined voltage. It is assumed that both of the data voltage Vd to be applied in the case of the scan line n−1 and that in the case of the scan line "n" are zero. When the gate voltage Vg is applied, the pixel voltage Vp decreases toward the data voltage Vd. However, since the application time Vgt1 of the gate voltage Vg is insufficient, the pixel voltage Vp does not drop to the data voltage Vd. There is consequently unapplied voltage Vr1.

Figure 8:
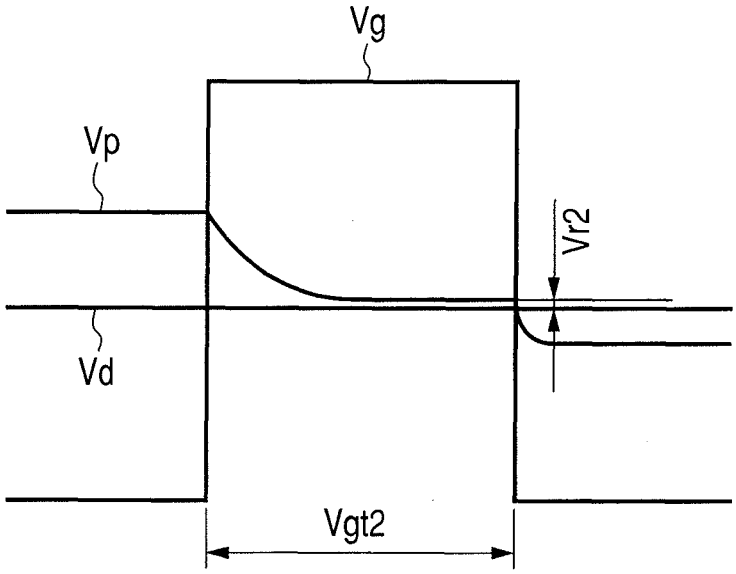
FIG. 8 shows an example of double-pulse writing in a dark field.

FIG. 8 shows the case where the double-pulse writing is applied under conditions similar to those of FIG. 7. The data voltage Vd to be applied in the case where the scan line n−1 is selected and that in the case where the scan line "n" is selected are zero, so that decrease in the pixel voltage Vp of the scan line "n" starts when the scan line n−1 is selected. Therefore, the write time of the data voltage Vd to the pixels in the scan line "n" is Vgt2 which is twice as long as Vgt1, and sufficient write time can be assured. Thus, the unapplied write voltage Vr2 in the double-pulse writing can be made largely smaller than the unapplied write voltage Vr1 in the single-pulse writing. FIG. 8 shows the case where the double-pulse writing displays the effect most in the dark field.

Figure 9:
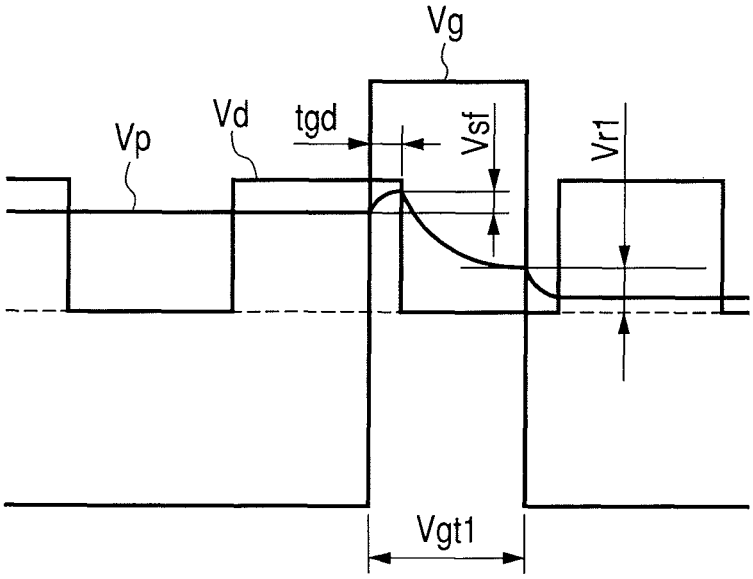
FIG. 9 shows another example of single-pulse writing in a dark field.

FIG. 9 shows the case where the data voltage Vd to be applied in the scan line n−1 is constant voltage and that in the scan line "n" is zero in the dark field in the single pulse writing. In this case, when the scan line "n" is selected, the pixel voltage Vp increases by the V shift Vsf and, after that, decreases toward zero. However, since the application time Vtg1 of the gate voltage Vg is not sufficient, the unapplied voltage Vr1 remains in the pixel electrode.

Figure 10:
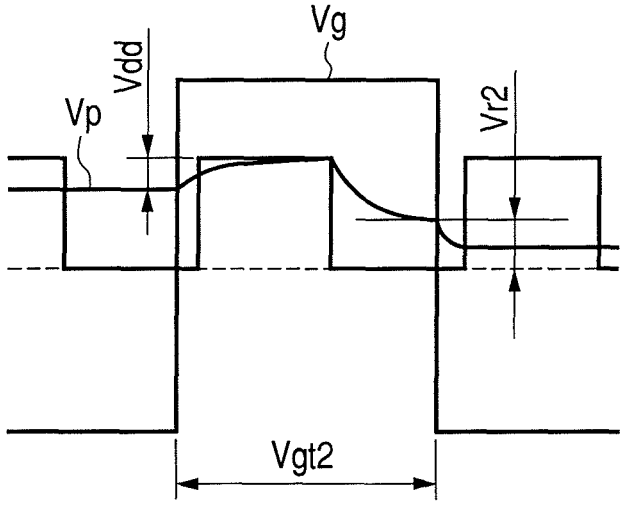
FIG. 10 shows another example of double-pulse writing in a dark field.

FIG. 10 shows the case where the double-pulse writing is applied under the same conditions as those of FIG. 9. The data voltage Vd to be applied is constant voltage in the scan line n−1 and is zero in the scan line "n". When the gate voltage Vg is applied also to the scan line "n" in the case where the scan line n−1 is selected, the pixel electrode voltage Vp on the scan line "n" rises toward the predetermined voltage Vd. The rise of the pixel voltage on the scan line "n" in this case is set as Vdd. After that, when the data voltage for the scan line "n" is applied, the pixel electrode voltage Vp decreases toward zero. In this case as well, before the pixel electrode drops to zero, the gate voltage is turned off, and the unapplied voltage Vr2 remains.

The problem of the double-pulse writing in this case is that before the data voltage Vd (zero in this case) is applied to the scan line "n", the pixel voltage Vp is increased by the amount of Vdd by the data voltage Vd on the scan line n−1. As a result, the unapplied voltage Vr2 in the double-pulse writing is higher than the unapplied voltage Vr1 in the single-pulse writing only by Vdd. That is, in this case, the reproducibility of an image in the double-pulse writing is worse than that in the single-pulse writing.

As described above, when the double-pulse writing is employed in the dark field, the unapplied voltage may decrease or increase. There is a case such that the unapplied voltage increases when the double-pulse writing is employed in the dark field. It means that the picture quality in a picture as a whole is lower than that in the single-pulse writing. On the other hand, in the light field, by employing the double-pulse writing, the unapplied voltage can be always decreased. Therefore, by employing the double-pulse writing in the light field, the picture quality can be always improved.

Therefore, in the present invention, the double-pulse writing is employed in the light field, and the single-pulse writing is employed in the dark field. It can reduce the problem of the write time of the data voltage Vd in the case where one frame is formed by a light field and a dark field, and the picture quality can be improved.

In the embodiment of the invention, the timing signal generating circuit 104 in FIG. 1 sends data indicating that the double-pulse writing or the single-pulse writing is used to the scan driver 104 as a part of the scan driver control signal group 109 to the scan driver 124 synchronously with the data selection signal 107 instructing selection of light field display data or dark field display data. Since the present invention employs the double-pulse writing in the light field, a drive method capable of using the double-pulse writing such as a column-by-column inverting method or a frame inverting method is also employed.

Second Embodiment

The first embodiment solves the problem that the write time of the signal voltage Vd becomes the half in the case of reducing a moving picture blurring by dividing one frame into two fields; the light field and the dark field. FIG. 2 shows the tone—luminance characteristic of each of fields in the case of dividing one frame into two fields. When the tone exceeds 171 in FIG. 2, the dark field also contributes to image formation, so that the effect of insertion of a black frame cannot be obtained. That is, when the tone exceeds 171, the effect on reduction in a moving picture blurring decreases.

Figure 11:
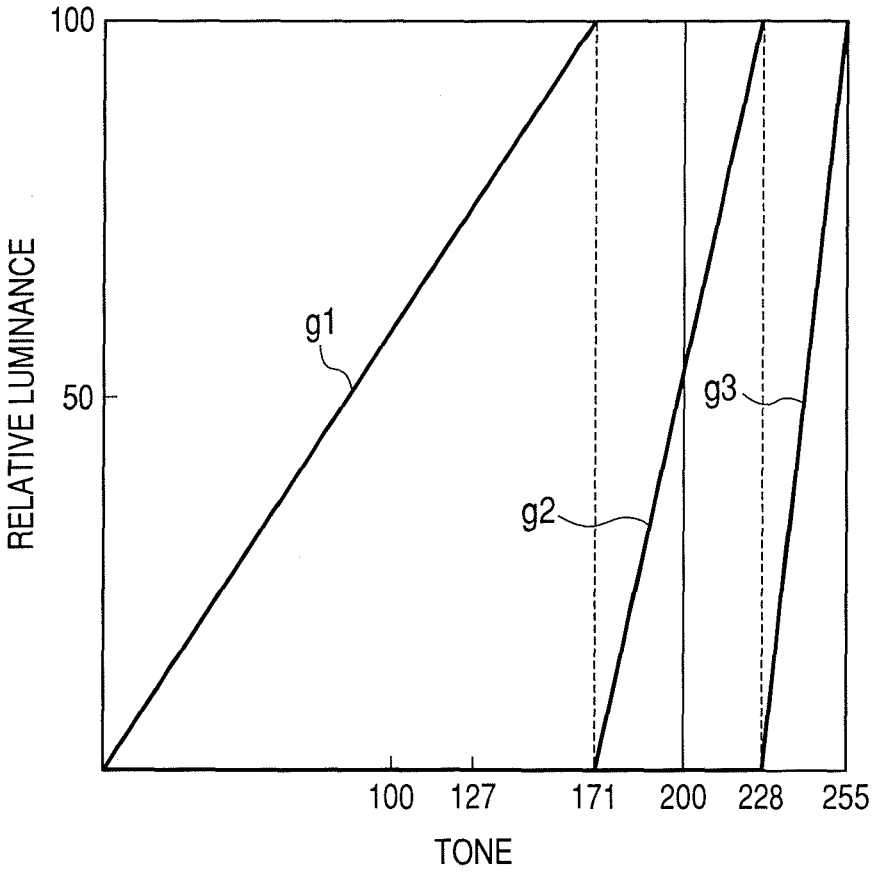
FIG. 11 shows a tone-luminance characteristic in each field of the first embodiment.

FIG. 11 shows a method of reducing a moving picture blurring more finely by forming one frame by three fields. In FIG. 11, the tone-luminance characteristic of the first field is g1, the tone-luminance characteristic of the second field is g2, and the tone-luminance characteristic of the third field is g3. In all of the fields, the same time is assigned. The order of the first field, the second field, and the third field exerts an important influence on the moving picture blurring. It is assumed here that an image is displayed in order of the first field, the second field, and the third field.

In FIG. 11, in the case of displaying 200 gray levels, the first and second fields are used and a black frame is displayed in the third field. That is, in FIG. 2, in the case of displaying 200 gray levels, a complete black frame cannot be inserted. In contrast, in FIG. 11, a complete black frame can be inserted also in the case of displaying 200 gray levels, and a moving picture blurring can be also accordingly reduced.

As described above, the 1-frame 3-field method displays an excellent effect against a moving picture blurring, but has a problem that the write time of the data voltage Vd to the pixel electrode is ⅓ of that of the normal case. That is, in this case, the unapplied voltage is a bigger issue as compared with that in the first embodiment. It is therefore important to consider the double-gate writing also in the 1-frame 3-field method.

In the second embodiment, the first field having the tone-luminance characteristic g1 in FIG. 11 is similar to the light field in the first embodiment. Consequently, by employing the double-pulse writing, the unapplied voltage can be reduced in all of the cases. Therefore, in the second embodiment, the double-pulse writing is preferably employed in the first field.

Since the second field having the tone-luminance characteristic g2 in FIG. 11 follows the first field, it corresponds to the dark field in the first embodiment. Therefore, in this case, by using the double-pulse writing, the unapplied voltage may decrease or increase. In this case, the double-pulse writing is not employed, but the single-pulse writing is employed.

The third field having the tone-luminance characteristic g3 in FIG. 11 follows the second field. In this case, the second field corresponds to the light field in the first embodiment, and the third field corresponds to the dark field in the first embodiment. Therefore, in the case of employing the double-pulse writing, the unapplied voltage may decrease or increase in the third field, so that the single-pulse writing is employed also in the third field.

As described above, in the case of forming one frame by three fields of different luminance, when the fields are displayed in the decreasing order of luminance, the double-pulse writing is used for the first field, and the single-pulse writing is employed for the subsequent fields. With the arrangement, the unapplied voltage in the field of the highest luminance having the greatest influence on formation of an image can be decreased, and deterioration in sinking of black data in a field of lower luminance is prevented. Thus, an image having excellent reproducibility as a whole can be obtained.

Third Embodiment

In the case of forming one frame by three fields of different luminance, the order of the three fields may be set in various ways. The second embodiment relates to the case of displaying the fields in the decreasing order of luminance. In the third embodiment, the third field having the tone-luminance characteristic g3 in FIG. 11 is positioned first in a frame. The second field having the tone-luminance characteristic g2 is positioned second. The first field having the tone-luminance characteristic g1 is positioned third.

The first field is a field of the lowest luminance. Immediately before the first field, the lightest field in the preceding frame is displayed. Therefore, the first field is in the same state as the dark field in the first embodiment. That is, it is preferable to drive the field by the single-pulse writing.

The next field has the intermediate luminance which is lower than the luminance of the first field. In this case, therefore, the field is in the same state as the light field in the first embodiment. That is, it is preferable to drive the field by the double-pulse writing.

The last field has the highest luminance. Since the field corresponds to the light field in the first embodiment, it is preferable to drive the field by the double-pulse writing.

As described above, in the third embodiment, the double-pulse writing is performed in the two fields out of the three fields. Therefore, in the third embodiment, the characteristic of the double-pulse writing can be displayed easily.

As understood from the foregoing embodiments, in the case of forming one frame by a plurality of fields of different luminance, which one of the double-pulse writing and the single-pulse writing is employed is determined whether the preceding field is a field of higher luminance or not in consideration of preceding and subsequent frames. Specifically, when the preceding frame is a field having luminance lower than that of the present field, the double-pulse writing is employed. When the preceding frame is a field having luminance higher than that of the present field, the single-pulse writing is employed. In such a manner, an image with excellent reproducibility and with little unapplied voltage can be obtained.

Fourth Embodiment

In the second and third embodiments, the example of forming one frame by three fields of different luminance has been described. To improve the moving picture characteristics more finely, one frame may be made of four or more fields of different luminance. In this case, the time of writing data to pixels is further shortened, so that the problem of the unapplied voltage is more serious. Therefore, the optimum driving method has to be set by using both of the double-pulse writing and the single-pulse writing. In this case as well, the double pulse writing is employed for the field of the highest luminance like in the first to third embodiments.

With respect to the other fields, the operation is performed as follows. A set of two frames is considered. When a field having a luminance higher than that of a specific field is set before the specific field, the single-pulse writing is performed for the specific field. When a field having a luminance lower than that of the specific field is set before the specific field, the double-pulse writing is performed for the specific field.

With the arrangement, also in the case where one frame is made of four or more fields of different luminance, the problem of decrease in the write time is suppressed, and an image having higher reproducibility can be formed.

Although the display device is described as a liquid crystal display device using the TFTs in the foregoing embodiments, the invention can be also applied to an organic EL display device using TFTs as a hold-response-type display device like the liquid crystal display device.

What is claimed is:

1. A display device comprising a number of pixels formed in a matrix and surrounded by a plurality of data signal lines extended in a vertical direction and arranged in a lateral direction and a plurality of scan lines extended in the lateral direction and arranged in the vertical direction, a scan line being selected by application of a gate voltage to the scan line, and a pixel voltage being supplied to pixels from a data signal line, wherein: data of three fields is generated from input image data of one frame, said one frame including said three fields, the three fields comprising a field of relatively high luminance, a field of intermediate luminance, and a field of relatively low luminance;

the scan line is selected in a first period using a single-pulse writing, and the scan line is selected in a second period using a double-pulse wiring, wherein the second period is twice as long as the first period, at the time of generating an image of the field of relatively high luminance, a scan line connected to the pixel is selected using the double-pulse writing in one field; and at the time of generating an image of the field of relatively low luminance, the scan line connected to the pixel is selected using the single-pulse writing in one field.

2. The display device according to claim 1, wherein the display device is a hold-response-type display device that holds display of tone for a predetermined period.

3. The display device according to claim 1, wherein the display device is a liquid crystal display device.

4. The display device according to claim 1, wherein the display device is an organic EL display device.

5. The display device according to claim 1, wherein when the field of intermediate luminance follows the field of relatively high luminance, the scan line connected to the pixels is selected once in one field.

6. The display device according to claim 1, wherein when the field of intermediate luminance follows the field of relatively low luminance, a scan line connected to the pixels is selected twice in a row in one field.

7. A display device comprising a number of pixels formed in a matrix and surrounded by a plurality of data signal lines extended in a vertical direction and arranged in a lateral direction and a plurality of scan lines extended in the lateral direction and arranged in the vertical direction, a scan line being selected by application of a gate voltage to the scan line, and a pixel voltage being supplied to pixels from a data signal line, wherein: data of three fields is generated from input image data of one frame, said one frame including said three fields, the three fields comprising a field of relatively high luminance, a field of intermediate luminance, and a field of relatively low luminance;

the scan line is selected in a first period using a single-pulse writing, and the scan line is selected in a second period using a double-pulse wiring, wherein the second period is twice as long as the first period, at the time of generating an image of the field of relatively high luminance, two kinds of image voltages are supplied successively from a data signal line to pixels using the double-pulse writing in one field; and at the time of generating an image of the field of relatively low luminance, one kind of image voltage is supplied from a data signal line to the pixels using the single-pulse writing in one field.

8. The display device according to claim 7, wherein when the field of intermediate luminance follows the field of relatively high luminance, two kinds of image voltages are supplied successively from a data signal line to the pixels in one field.

9. The display device according to claim 7, wherein when the field of intermediate luminance follows the field of relatively low luminance, two kinds of image voltages are supplied successively from a data signal line to the pixels in one field.

10. The display device according to claim 7, wherein the display device is a hold-response-type display device that holds display of tone for a predetermined period.

11. The display device according to claim 7, wherein the display device is a liquid crystal display device.

12. The display device according to claim 7, wherein the display device is an organic EL display device.

13. A display device comprising a number of pixels formed in a matrix and surrounded by a plurality of data signal lines extended in a vertical direction and arranged in a lateral direction and a plurality of scan lines extended in the lateral direction and arranged in the vertical direction, a scan line being selected by application of a gate voltage to the scan line, and a pixel voltage being supplied to pixels from a data signal line, wherein:

the display device is configured to form a plurality of frames, each frame including four or more fields, and, in the case where data of four or more fields of different luminance including a field of maximum luminance and a field of minimum luminance is generated from input image data of one of the frames, and an image is formed by the four or more fields, in a method of driving a specific one of the fields, when two of the frames are successively selected, the scan line is selected in a first period using a single-pulse writing, and the scan line is selected in a second period using a double-pulse wiring, wherein the second period is twice as long as the first period;

if a field of luminance lower than that of the specific field is sent before the specific field, a scan line connected to pixels is selected using the double-pulse writing in one field in the specific field; and when a field having luminance higher than that of the specific field is set before the specific field, a scan line connected to pixels in the specific field is selected using the single-pulse writing in one field.

14. The display device according to claim 13, wherein the display device is a hold-response-type display device that holds display of tone for a predetermined period.

15. The display device according to claim 13, wherein the display device is a liquid crystal display device.

16. The display device according to claim 13, wherein the display device is an organic EL display device.

* * * * *